US010408121B2

(12) United States Patent
Hornbach et al.

(10) Patent No.: US 10,408,121 B2
(45) Date of Patent: Sep. 10, 2019

(54) SUPERCHARGING DEVICE FOR A COMBUSTION ENGINE

(71) Applicant: BorgWarner Inc., Auburn Hills, MI (US)

(72) Inventors: Johannes Hornbach, Frankenthal (DE); Michael Kolano, Ebertsheim (DE); Dietmar Metz, Meckenheim (DE); Daniel Speller, Kayl (LU)

(73) Assignee: BorgWarner Inc., Auburn Hills, MI (US)

( * ) Notice: Subject to any disclaimer, the term of this patent is extended or adjusted under 35 U.S.C. 154(b) by 247 days.

(21) Appl. No.: 15/316,282

(22) PCT Filed: Jun. 5, 2015

(86) PCT No.: PCT/US2015/034328
§ 371 (c)(1),
(2) Date: Dec. 5, 2016

(87) PCT Pub. No.: WO2015/188028
PCT Pub. Date: Dec. 10, 2015

(65) Prior Publication Data

US 2017/0152792 A1 Jun. 1, 2017

(30) Foreign Application Priority Data

Jun. 6, 2014 (DE) ..... 10 2014 210 891
Jul. 9, 2014 (DE) ..... 10 2014 213 382

(51) Int. Cl.
*F02B 33/40* (2006.01)
*F02B 39/10* (2006.01)
(Continued)

(52) U.S. Cl.
CPC ..... *F02B 33/40* (2013.01); *F02B 39/10* (2013.01); *F04D 13/062* (2013.01);
(Continued)

(58) Field of Classification Search
CPC ..... F02B 39/10; F04D 29/5806
(Continued)

(56) References Cited

U.S. PATENT DOCUMENTS 5,350,039 A 9/1994 Voss et al.
5,638,796 A * 6/1997 Adams, III ..... F02B 33/40 123/565
(Continued)

FOREIGN PATENT DOCUMENTS

CN 1281535 A 1/2001
EP 2623781 A1 8/2013
(Continued)

OTHER PUBLICATIONS

Chinese Office Action (with English language translation) dated Jul. 24, 2018, in Chinese Application No. 201580040403.1.
(Continued)

*Primary Examiner* — Phutthiwat Wongwian
*Assistant Examiner* — Edward Bushard
(74) *Attorney, Agent, or Firm* — Eric L. Doyle; Stephan A. Pendorf; Patent Central LLC

(57) ABSTRACT

A supercharging device for an internal combustion engine, in particular for a vehicle, with a compressor having a compressor housing and having a compressor space in which a compressor wheel is arranged, an electric motor having a rotor and a stator, a motor housing having a motor space for accommodating the rotor and the stator, and a fluid-conducting connection from the compressor space into the motor space in order to permit pressure equalization between the compressor space and the motor space.

19 Claims, 8 Drawing Sheets

(51) Int. Cl.

| | |
|---|---|
| ***F04D 25/06*** | (2006.01) |
| ***F04D 29/66*** | (2006.01) |
| ***F04D 29/70*** | (2006.01) |
| ***F04D 13/06*** | (2006.01) |
| ***F04D 29/08*** | (2006.01) |

(52) U.S. Cl.
CPC ..... *F04D 25/0606* (2013.01); *F04D 25/068* (2013.01); *F04D 25/0693* (2013.01); *F04D 29/083* (2013.01); *F04D 29/668* (2013.01); *F04D 29/701* (2013.01)

(58) Field of Classification Search
USPC ..... 123/565; 417/366
See application file for complete search history.

(56) References Cited

U.S. PATENT DOCUMENTS

| | | | |
|---|---|---|---|
| 5,904,471 A | | 5/1999 | Woollenweber et al. |
| 6,102,672 A | * | 8/2000 | Woollenweber .... F04D 29/5806 417/366 |
| 2009/0016911 A1 | | 1/2009 | Noelle |
| 2010/0135769 A1 | | 6/2010 | Kleynhans et al. |
| 2013/0224050 A1 | | 8/2013 | Nakagami et al. |
| 2014/0090626 A1 | | 4/2014 | An et al. |

FOREIGN PATENT DOCUMENTS

| | | | |
|---|---|---|---|
| EP | 2639425 | A1 | 9/2013 |
| EP | 2733326 | A1 | 5/2014 |
| JP | 2001515991 | A | 9/2001 |
| JP | 2001527613 | A | 12/2001 |
| JP | 2010525224 | A | 7/2010 |
| WO | 9830790 | A2 | 7/1998 |

OTHER PUBLICATIONS

Partial International Search Report in International Application No. PCT/US2015/034328, dated Aug. 31, 2015.
International Search Report and Written Opinion in International Application No. PCT/US2015/034328, dated Jan. 26, 2016.
Japanese Office Action (with English language translation) dated Nov. 26, 2018, in Japanese Application No. 2016-571344.

* cited by examiner

SUPERCHARGING DEVICE FOR A COMBUSTION ENGINE

FIELD OF THE INVENTION

The present invention relates to a supercharging device for an internal combustion engine, in particular in a vehicle.

BACKGROUND TO THE INVENTION

Supercharging devices for internal combustion engines which compress the charge air of the internal combustion engine by means of a compressor are known from the prior art. In the case of the supercharging devices under consideration here, the compressor wheel in the compressor is driven by means of an electric motor.

SUMMARY OF THE INVENTION

It is the object of the present invention to provide a supercharging device for an internal combustion engine, which supercharging device, while being inexpensive to produce and requiring little maintenance, exhibits high operational endurance strength. At the same time, the supercharging device should be of very small and lightweight construction.

The object is achieved by the features of claim 1. The dependent claims relate to advantageous refinements of the invention.

According to a first, general aspect, the supercharging device and the internal combustion engine are used in particular in a vehicle. The supercharging device comprises a compressor having a compressor housing and having a compressor space. A compressor wheel is arranged in the compressor space. The supercharging device furthermore comprises an electric motor with a rotor and a stator. A motor housing is also provided. A motor space is formed in the motor housing. Said motor space serves for accommodating the stator and the rotor. A power electronics circuit for controlling the electric motor is arranged in a receiving space. The receiving space is hermetically sealed with respect to the compressor space and the motor space. This has the advantage that no fluids and/or particles can pass from the compressor space or the motor space into the receiving space with the power electronics circuit.

In refinements, a means may be provided for permitting pressure equalization between the receiving space and the surroundings. It may furthermore be provided that at least one electrical conductor extends from the power electronics circuit through the motor housing in order to permit an electrically conductive connection between the power electronics circuit and the electric motor. Furthermore, the supercharging device may have a fluid-conducting connection from the compressor space into the motor space in order to permit pressure equalization between the compressor space and the motor space. This has the advantage that large pressure differences between the motor space and the compressor space can be avoided. In this way, the forces on the seals and the bearings that arise for example owing to high pressures without pressure equalization can be eliminated or reduced. This reduces the risk of lubricant or the like being forced out of the bearings and/or seals into the compressor space and/or the motor space and causing damage there. The supercharging device may furthermore have a bearing device for the mounting of a shaft which connects the rotor to the compressor wheel, wherein the bearing device has a means for vibration damping. The vibration damping permits, for example, smoother and more uniform running of the shaft with less vibration.

According to a second, general aspect, a supercharging device for an internal combustion engine, in particular a vehicle, has the following: a compressor having a compressor housing and having a compressor space in which a compressor wheel is arranged, an electric motor, a receiving space in which a power electronics circuit for controlling the electric motor is arranged, and a means for permitting pressure equalization between the receiving space and the surroundings.

In refinements, the electric motor may have a motor housing which defines a motor space. The receiving space may be hermetically sealed with respect to the compressor space and the motor space. It may furthermore be provided that at least one electrical conductor extends from the power electronics circuit through the motor housing in order to permit an electrically conductive connection between the power electronics circuit and the electric motor. Furthermore, the supercharging device may have a fluid-conducting connection from the compressor space into the motor space in order to permit pressure equalization between the compressor space and the motor space. The supercharging device may have a bearing device for the mounting of a shaft which connects the rotor to the compressor wheel, wherein the bearing device has a means for vibration damping.

According to a third, general aspect, a supercharging device for an internal combustion engine, in particular a vehicle, has the following: a compressor having a compressor housing and having a compressor space in which a compressor wheel is arranged, an electric motor having a motor housing which defines a motor space in which a rotor and a stator are arranged, a receiving space in which a power electronics circuit for controlling the electric motor is arranged. At least one electrical conductor extends from the power electronics circuit through the motor housing in order to permit an electrically conductive connection between the power electronics circuit and the electric motor.

In refinements, the receiving space may be hermetically sealed with respect to the compressor space and the motor space. Furthermore, a means may be provided for permitting pressure equalization between the receiving space and the surroundings. Furthermore, the supercharging device may have a fluid-conducting connection from the compressor space into the motor space in order to permit pressure equalization between the compressor space and the motor space. The supercharging device may have a bearing device for the mounting of a shaft which connects the rotor to the compressor wheel, wherein the bearing device has a means for vibration damping.

According to a fourth, general aspect, a supercharging device for an internal combustion engine, in particular a vehicle, has the following: a compressor having a compressor housing and having a compressor space in which a compressor wheel is arranged, an electric motor having a motor housing which defines a motor space in which a rotor and a stator are arranged, and a fluid-conducting connection from the compressor space into the motor space in order to permit pressure equalization between the compressor space and the motor space.

In refinements, a receiving space may be provided in which power electronics for controlling the electric motor are arranged. The receiving space may be hermetically sealed with respect to the compressor space and the motor space. Furthermore, a means may be provided for permitting pressure equalization between the receiving space and the surroundings. It may advantageously furthermore be provided that at least one electrical conductor extends from the power electronics circuit through the motor housing in order to permit an electrically conductive connection between the power electronics circuit and the electric motor. The supercharging device may furthermore have a bearing device for the mounting of a shaft which connects the rotor to the compressor wheel, and wherein the bearing device has a means for vibration damping.

According to a fifth, general aspect, a supercharging device for an internal combustion engine, in particular a vehicle, has the following: a compressor having a compressor housing and having a compressor space in which a compressor wheel is arranged, an electric motor having a motor housing which defines a motor space in which a rotor and a stator are arranged, a shaft which connects the rotor rotationally conjointly to the compressor wheel, and a bearing device for the mounting of the shaft, wherein the bearing device has a means for vibration damping.

In refinements, a receiving space may be provided in which power electronics for controlling the electric motor are arranged. The receiving space may be hermetically sealed with respect to the compressor space and the motor space. Furthermore, a means may be provided for permitting pressure equalization between the receiving space and the surroundings. It may advantageously furthermore be provided that at least one electrical conductor extends from the power electronics circuit through the motor housing in order to permit an electrically conductive connection between the power electronics circuit and the electric motor. Furthermore, the supercharging device may have a fluid-conducting connection from the compressor space into the motor space in order to permit pressure equalization between the compressor space and the motor space.

Below, further advantageous aspects will be described which may be individually and jointly combined with all of the aspects of the supercharging device described above.

It may be provided that the means for pressure equalization is a fluid-conducting connection from the receiving space into the surroundings, in particular a hole or a bore. Furthermore, the means for pressure equalization may have a diaphragm, in particular a semipermeable diaphragm. Said diaphragm may thus for example be impermeable to liquids and permeable to gases, such that pressure equalization between the receiving space and the surroundings is possible. For the electrical contacting of the power electronics circuit in the receiving space, a connection of the receiving space to the surroundings may be provided, for example in the form of a plug connector. In particular, the means for pressure equalization may be integrated into a plug connector of said type. The plug connector may be suitable for the control of the power electronics circuit and/or for the supply of power to the electric motor. For example, the means for pressure equalization may be integrated in a collar of the plug connector. This has the advantage that a single component can be used both for the electrical contacting of the power electronics circuit and for permitting pressure equalization. In addition or alternatively, the means for pressure equalization may also comprise a valve and/or a nozzle, for example in the form of a Venturi nozzle. Controlled and regulated pressure equalization is thus made possible.

In refinements, it may be provided that the compressor housing is closed on the side facing toward the motor housing by a rear wall, wherein the rear wall is situated opposite a wall of the motor housing, and wherein the receiving space for the power electronics circuit is arranged between the wall and the rear wall. Thus, before the assembly process, the compressor housing has an open side on its side facing toward the stator. Said open side is situated between the compressor wheel and the electric motor. The open side can be closed by means of the rear wall. To ensure the producibility and assemblability of the supercharging device, said rear wall may be an independent component manufactured separately from the compressor housing. The power electronics circuit serves for controlling the electric motor. Said receiving space may be hermetically sealed with respect to the compressor space and the motor space. The hermetic sealing means in particular that there is a sealing action both with respect to gases and with respect to liquids. In advantageous refinements, the rear wall may be manufactured from: plastic or metal, in particular a thermoset, high temperature-resistant polyamide, fiber-reinforced plastic, or aluminum. Furthermore, the rear wall may have multiple reinforcement ribs. In this case, the reinforcement ribs may extend outward in stellate fashion from a central recess of the rear wall. In particular, the reinforcement ribs may be formed on that side of the rear wall which faces toward the electric motor.

In one refinement, studs with a height of 0.1 mm-0.6 mm, in particular 0.2 to 0.4 mm, may be provided on the rear wall on a side facing toward the compressor, which studs provide defined axial positioning of the rear wall relative to the compressor housing. In a further refinement, the studs may be of convexly shaped form, such that they are easily deformable.

For the hermetic sealing, it is preferably possible for a first seal to be provided on a first outer circumferential surface of the rear wall, wherein the first seal is arranged between a first radial surface of the wall of the motor housing and a second radial surface of the compressor housing and is subjected to load only in an axial direction. The three components—compressor housing, motor housing and rear wall—thus make contact with the first seal, such that a radially outer side of the receiving space is sealed off by way of the first seal. It is alternatively also possible for two first seals to be used, wherein then, one first seal is arranged axially between the compressor housing and rear wall, and the other first seal is arranged axially between the rear wall and motor housing.

An axially extending section may be formed on the wall of the motor housing, wherein the power electronics circuit is arranged radially within the section, and wherein the first radial surface is arranged on the axially extending section. Said section is in particular formed over the full circumference, and extends in the direction of the compressor housing. The length of the section defined here thus determines the size of the receiving space in the axial direction.

A recess for the leadthrough of a shaft from the motor space into the compressor space may be formed in the wall of the motor housing and the rear wall, wherein a second seal may be arranged between the rear wall and wall in the region of the recess. The receiving space can be sealed off at its inner circumference by means of said second seal. The rotor and the compressor wheel are preferably arranged coaxially, such that a continuous shaft can be used. Provision is preferably made for the second seal to be arranged such that an inner circumferential surface of the rear wall and a second outer circumferential surface of the wall of the motor housing bear against the second seal.

The first seal and/or the second seal may be adhesively bonded to or vulcanized onto the rear wall. In refinements, the first seal and/or the second seal may additionally or alternatively be arranged in a groove in the rear wall, or a corresponding projection of the rear wall may project into a corresponding groove in the first seal and/or in the second seal. In particular, rubber, natural rubber or hydrogenated acrylonitrile butadiene rubber (HNBR) may be used as material for the first seal and/or the second seal.

In refinements, it may be provided that the direct fluid-conducting connection from the compressor space into the motor space has a pipe stub for permitting pressure equalization between the two spaces. Said pipe stub extends in the axial direction through the rear wall, the receiving space and the wall of the motor housing into the motor space in order to form a direct fluid-conducting connection between the motor space and the compressor space. Here, the pipe stub is formed such that only a fluid-conducting connection between compressor space and motor space, and not a fluid-conducting connection into the receiving space, can be realized. It may preferably be provided that the pipe stub is an integral constituent part of the rear wall, which is manufactured in one piece. Furthermore, the pipe stub is advantageously situated eccentrically with respect to the shaft of the supercharging device.

The fluid-conducting connection between the compressor space and the motor space for permitting the pressure equalization may have further components. For example, at least one diaphragm may be provided, for example a semi-permeable diaphragm, for the targeted passage of gases and retention of solid or liquid particles. The diaphragm may be mounted in the pipe stub, on the rear wall at the inlet opening and/or at an outlet of the pipe stub in the region of the motor space. In addition or alternatively, a device may also be provided which regulates or controls the fluid-conducting connection or the throughflow through the fluid-conducting connection between the spaces. Such a device may be integrated in the form of a valve and/or a nozzle, for example a Venturi nozzle. This has the advantage that, by means of the fluid-conducting connection between the compressor space and the motor space, not only is a pressure equalization made possible, but at the same time the pressure equalization can be controlled and/or regulated, and/or contamination by liquids or particles can be prevented.

In the compressor, it is necessary to as far as possible prevent particles from passing into the motor space via the inlet opening of the fluid-conducting connection or of the pipe stub. Such particles may in particular be burned oil droplets or soot particles. To prevent this, use is made not only of the features already described above but also of the following further distinguishing features, which may be implemented individually or in combination.

The compressor wheel has a certain diameter D1. The center of an inlet opening of the fluid-conducting connection or of the pipe stub in the rear wall may be spaced apart from a central point M of the rear wall by a distance A1. The distance A1 lies preferably between 0.2*(D1/2) and 0.9*(D1/2), in particular between 0.4*(D1/2) and 0.8*(D1/2).

In refinements, it may be provided that at least one elevation for channeling away particles is formed, in the region of the inlet opening of the pipe stub, on that side of the rear wall which faces toward the compressor. In particular, the at least one elevation extends in a circumferential direction. It is furthermore preferably provided that the at least one elevation is situated over the full circumference around the inlet opening of the pipe stub. In particular, it is provided that one or more elevations are arranged in sickle-shaped form around the inlet opening in the circumferential direction. During the operation of the supercharging device, the at least one elevation has the effect that particles, owing to their inertia, are at least with high probability centrifuged past the inlet opening and, for example, are not discharged with the condensate but are supplied with the compressed air to the combustion process in the internal combustion engine.

At least two elevations may be provided. The elevations are preferably separated from one another by a depression. An imaginary line 44 is defined which runs through the center of the inlet opening and through the central point M of the rear wall. The depression extends along an imaginary auxiliary axis. The auxiliary axis preferably intersects the line 44 connecting the center of the inlet opening and the central point M radially outside the inlet opening.

It may preferably be provided that in each case at least one first depression and a corresponding multiplicity of elevations are provided in front of and behind the inlet opening as viewed in the circumferential direction. Then, the auxiliary axes of the first depressions enclose a first angle ($\alpha_1$, $\beta_1$) respectively with the line 44 connecting the center of the inlet opening and the central point M, and advantageously intersect the line 44 connecting the center of the inlet opening and the central point M radially outside the inlet opening.

It may furthermore preferably be provided that second depressions and correspondingly further elevations are provided in front of and behind the first depressions as viewed in the circumferential direction. The auxiliary lines of the second depressions enclose a second angle ($\alpha_2$, $\beta_2$) respectively with the line 44 connecting the center of the inlet opening and the central point M, and intersect the line 44 connecting the center of the inlet opening and the central point M radially outside the inlet opening.

The first and second angles ($\alpha_1$, $\beta_1$, $\alpha_2$, $\beta_2$) each lie between 70° and 20°, preferably between 60° and 25°. The first angles ($\alpha_1$, $\beta_1$) are advantageously smaller than the second angles ($\alpha_2$, $\beta_2$). In particular, the first angles ($\alpha_1$, $\beta_1$) amount to at most 95% of the second angles ($\alpha_2$, $\beta_2$).

The compressor wheel has the diameter D1 (greatest diameter of the compressor wheel). The totality of the elevations may extend over a length L. The length L is measured perpendicular to the line 44 connecting the center of the inlet opening and the central point M and parallel to a plane spanned by the rear wall. The length L runs perpendicular to the axis of the shaft. The length L preferably amounts to between 0.7*D1 and 0.2*D1, in particular between 0.6*D1 and 0.3*D1.

The totality of the elevations may extend over a segment angle $\gamma$ measured with respect to the central point M of the rear wall and in the plane of the rear wall. The segment angle $\gamma$ preferably lies between 120° and 45°, in particular between 100° and 60°.

The radially inner edge of the elevations may follow an arc. The arc preferably has a continuously varying radius with respect to the central point M. In particular, the arc defines a first radius R1 on the line 44 connecting the center of the inlet opening and the central point M, which radius increases up to a second radius R2 at the outer ends of the elevations. The second radius R2 particularly preferably amounts to at least 110% of the first radius R1.

A height H1 of the at least one elevation measured in an axial direction amounts to preferably between 0.1 mm and 5 mm, in particular between 0.1 mm and 1 mm.

The edges of the at least one elevation are preferably rounded with a defined radius R3. The radius preferably lies between 0.05 mm and 0.1 mm.

The arrangement of the elevations and depressions is preferably symmetrical with respect to the line 44 connecting the center of the inlet opening and the central point M running through the center of the inlet opening and through the center M of the rear wall.

These various features relating to the configuration and positioning of the inlet opening and of the elevations have been determined on the basis of calculations, simulations and tests, and may be used individually or in synergistically interactive combination to prevent particles from passing into the motor space via the inlet opening and the fluid-conducting connection. By contrast to the conventional and logical solution, specifically that of sealing off the motor space, it has been identified that the provision of a fluid-conducting connection between the compressor space and the motor space, for example in the form of a pipe stub, and the above-described elevations is significantly easier and cheaper than completely sealing off the motor space, with the correspondingly required pressure equalization.

At least one passage hole which is eccentric with respect to the shaft may advantageously be formed in the wall of the motor housing. The electrical conductor projects through said passage hole from the power electronics circuit to the stator. In preferred embodiments, the electrical conductor may be in the form of a pin. In particular, three such electrical conductors are used. Correspondingly, there are three passage holes in the wall of the motor housing. The electrical conductors serve in each case for the electrically conductive connection of the stator to the power electronics circuit. It may preferably be provided that the electrical conductor extends through the motor housing at least as far as that end of the stator which faces away from the compressor. That is to say, the electrical conductors advantageously extend in the axial direction over the entire length of the stator. One advantage of this is that the contacting between the stator and electrical conductor can thus be realized on that side of the stator which faces away from the compressor. In particular, it may be provided that the electrical conductors and the stator are electrically connected to one another by way of a crimped connection. Owing to the length of the electrical line and the crimping on the side facing away from the power electronics circuit, assembly damage to the power electronics circuit as a result of the crimping process can be prevented. On that side of the stator which faces away from the compressor, the motor housing advantageously has a cover. Before the mounting of said cover, it is possible, at said side, for the electrical conductors to be connected in electrically conductive fashion to the windings on the stator, for example by crimping as described. Only then is the cover correspondingly mounted. This arrangement permits simple assembly of the supercharging device, which is of very compact construction. Altogether, the configuration and arrangement of the electrical conductors thus has the advantages of fast and simple assembly with a low risk of assembly-induced damage, without the need to accept large power losses in the electrical connection.

There is preferably a third seal situated between each electrical conductor and the associated passage hole. In this way, the motor space can be hermetically sealed off with respect to the receiving space. The third seal may preferably be a hose-like rubber lining on the respective electrical conductor. Furthermore, it may preferably be provided that, on the third seal, there are encircling elevations for locally generating a relatively high contact pressure with respect to the passage hole in the wall. To prevent any short-circuits in the region of the electrical conductors, it is preferably provided that the third seal extends over at least half of the length of the stator, preferably over at least two thirds of the length of the stator, in the axial direction. In this way, the third seal serves not only for sealing off the passage hole but also at the same time for the electrical insulation of the electrical conductor.

As already described above, the shaft projects through the wall of the motor housing into the compressor. At this location, there may preferably be formed a fourth sealing point for sealing off the compressor space with respect to the motor space. The fourth sealing point is provided either in the form of a contactless seal or as a dynamic seal, in particular with at least one piston ring. In a preferred variant, in particular in the case of a motor housing composed of aluminum, however, a contact-type seal, in particular piston rings, is/are intentionally dispensed with in order to prevent "scuffing" (notching) of the piston rings in the motor housing.

For the hermetic sealing of the motor space with respect to the receiving space, it is advantageously the case that a fifth seal is provided between the fluid-conducting connection from the compressor space into the motor space, in particular in the form of a pipe stub, and the wall of the motor housing.

It may preferably be provided that the bearing device for the mounting of the shaft has at least two bearings, in particular rolling bearings, for the mounting of the shaft with respect to the motor housing or with respect to the motor housing and a cover of the motor housing. The means for vibration damping may for example have at least one O-ring, wherein the at least one O-ring is arranged between the bearing or the bearings and the adjoining motor housing and/or cover. The at least one O-ring is advantageously seated in a groove in an outer ring of the bearing. In addition or alternatively, a groove may also be provided in the motor housing and/or in the cover. The O-ring is preferably composed of HNBR, natural rubber or rubber. The motor housing and/or the cover may be manufactured from aluminum. The outer ring of the bearing is normally composed of steel. The O-ring can firstly serve for the avoidance of an inexpedient, chemically active material pairing. The O-ring secondly dampens mechanical vibrations. The O-ring thus ensures chemical and mechanical decoupling. In addition or alternatively, the means for vibration damping may have at least one spring element. In particular, the spring element may be arranged in the axial direction between the bearing and the motor housing and/or between the bearing and the cover.

Further details and features of the invention will be described on the basis of the following Figures, in which:

An exemplary embodiment of the supercharging device 1 will be described in detail below on the basis of FIGS. 1 to 9.

Figure 1:
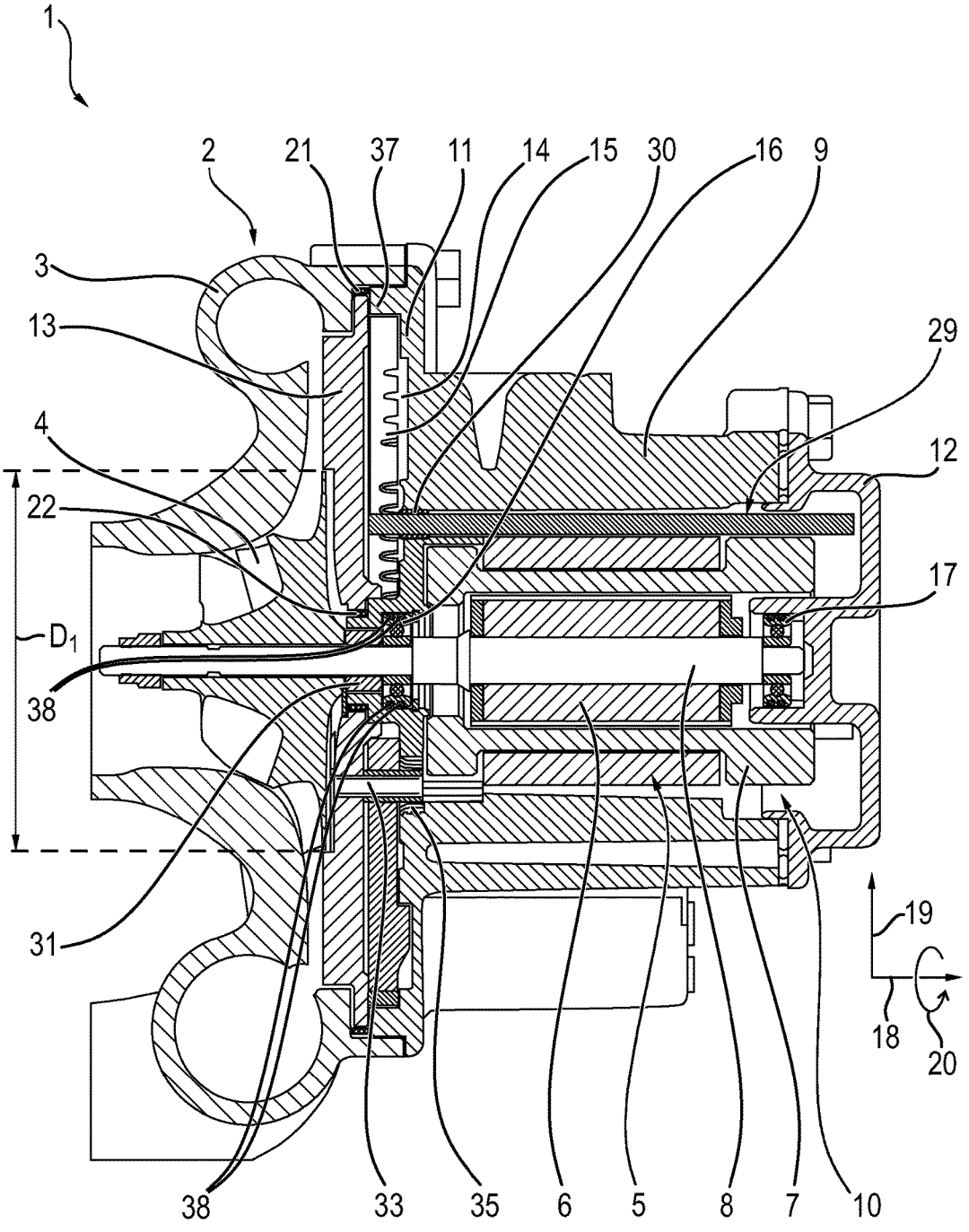
FIG. 1 shows a sectional view of a supercharging device according to the invention as per an exemplary embodiment.

FIG. 1 shows, in a sectional view, the supercharging device 1 comprising a compressor 2. The compressor 2 has a compressor housing 3. A compressor wheel 4 is arranged in the compressor housing 3. Said compressor wheel 4 is situated in the so-called compressor space.

Furthermore, the supercharging device 1 comprises an electric motor 5. The electric motor 5 is made up of a rotor 6 and a stator 7.

By means of a shaft 8, the rotor 6 is connected rotationally conjointly to the compressor wheel 4. Rotation of the electric motor 5 thus causes the compressor wheel 4 to also be set in rotation.

The compressor wheel 4 and the rotor 6 are arranged coaxially, such that the shaft 8 is at the same time also the rotor shaft.

FIG. 1 shows an axial direction 18 corresponding to the shaft 8. A radial direction 19 is perpendicular to the axial direction 18. A circumferential direction 20 is defined around the axial direction 18.

When the electric motor 5 rotates, and thus when the compressor wheel 4 rotates, air is drawn in the axial direction 18. By means of the compressor 2, the air is compressed in the radial direction 19 and supplied to an internal combustion engine.

The supercharging device 1 furthermore comprises a motor housing 9. A motor space 10 is formed in said motor housing 9. The motor space 10 is closed off, on the side facing away from the compressor 2, by means of a cover 12. In the direction of the compressor 2, the motor space 10 is delimited by a wall 11 of the motor housing 9. The compressor housing 3 is open on its side facing toward the motor housing 9. Said open side is closed by means of a rear wall 13. In particular, the rear wall 13 is manufactured from plastic, in particular a thermoset, or from metal, in particular aluminum. If said rear wall is manufactured from plastic, use is made in particular of high temperature-resistant polyamide. It is furthermore preferably provided that the rear wall 13 is manufactured from fiber-reinforced plastic.

Studs (not shown in the Figures) with a height of 0.1 mm-0.6 mm, in particular 0.2 to 0.4 mm, may be provided on the rear wall 13 on a side facing toward the compressor 2, which studs provide defined axial positioning of the rear wall 13 relative to the compressor housing. The studs may be of convexly shaped form, such that they are easily deformable.

The motor housing 9 is fixedly connected, in particular screwed, by way of its wall 11 to the compressor housing 3. Here, a receiving space 14 is formed between the rear wall 13 and the wall 11. In said receiving space 14 there is situated a power electronics circuit 15 for the supply of power to, and control of, the electric motor 5. The receiving space 14 is hermetically sealed with respect to the compressor space and with respect to the motor space 10. A means 40 may be provided which permits pressure equalization between the receiving space 14 and the surroundings. Further details regarding the means 40 for pressure equalization will be described in more detail below in conjunction with FIG. 9.

Figure 3:
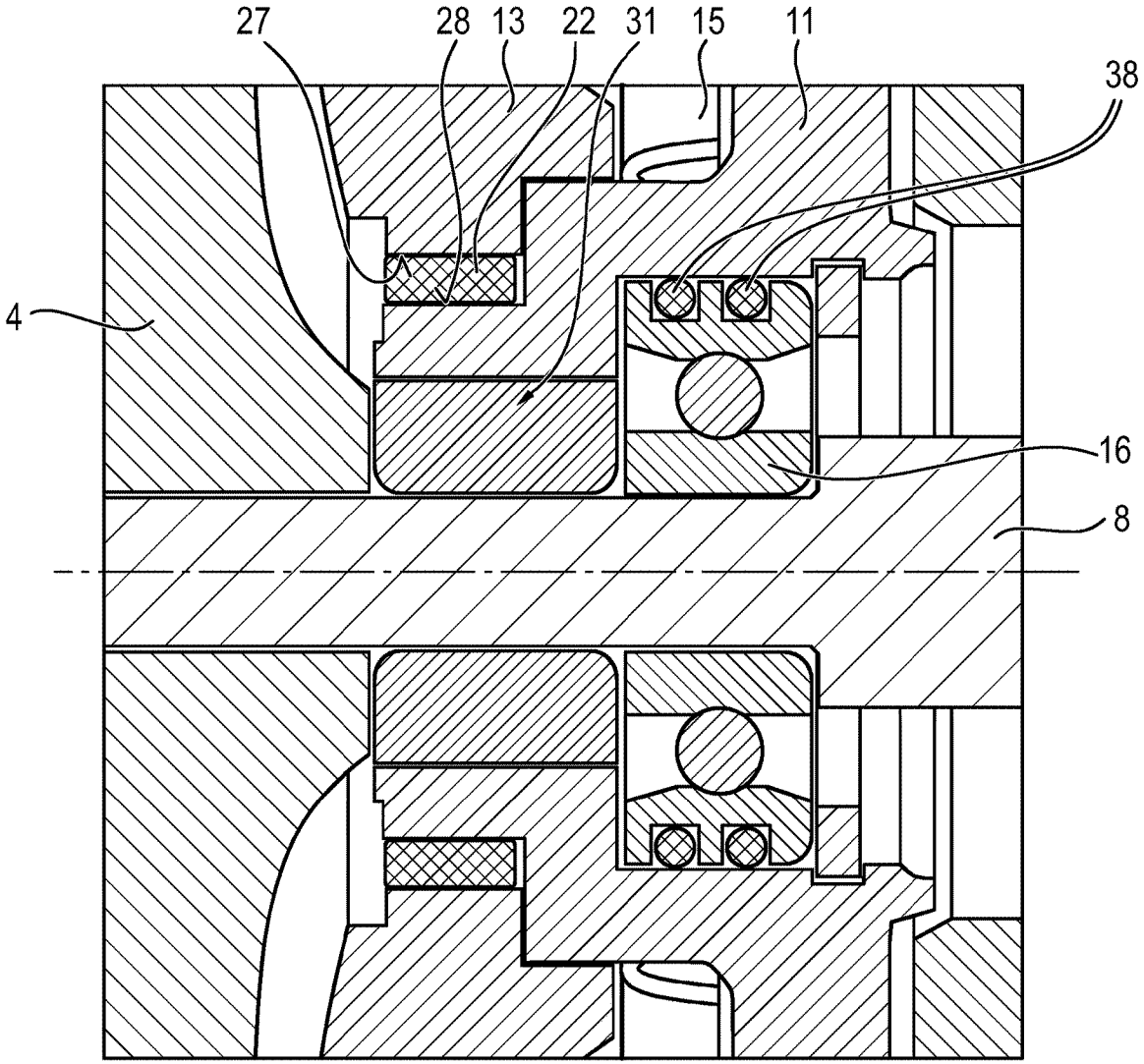
FIG. 3 shows a detail view relating to the second seal of the supercharging device according to the invention as per the exemplary embodiment.

The shaft 8 is mounted with respect to the wall 11 of the motor housing 9 by way of a first bearing 16. A second bearing 17 is situated between the shaft 8 and the cover 12. FIG. 3 shows two O-rings 38 between the outer ring of the first bearing 16 and the adjoining motor housing 9. Said O-rings serve inter alia as means for vibration damping. The O-rings may, as shown, be seated in a groove in the outer ring of the bearings 16 and 17 (see FIGS. 1 and 3). In addition or alternatively, a groove may also be provided in the motor housing 9 and/or in the cover 12. The O-rings 38 are preferably composed of HNBR, natural rubber or rubber. The motor housing 9 and/or the cover 12 may be manufactured from aluminum, for example. The outer ring of the bearings 16, 17 is normally composed of steel. The O-rings 38 can firstly serve for the avoidance of an inexpedient, chemically active material pairing. Secondly, the O-rings 38 dampen mechanical vibrations. The O-rings 38 thus ensure chemical and mechanical decoupling. In addition or alternatively, the means for vibration damping may have at least one spring element (not shown). The spring element may for example be arranged in the axial direction 18 between the bearing 16 and the motor housing 9 and/or between the bearing 17 and the cover 12 (for example in the free space between bearing 17 and cover 12, visible in FIG. 1).

The wall 11 of the motor housing 9 has an axially extending section 37. The power electronics circuit 15, and correspondingly the receiving space 14, are situated radially within said section 37.

Figure 2:
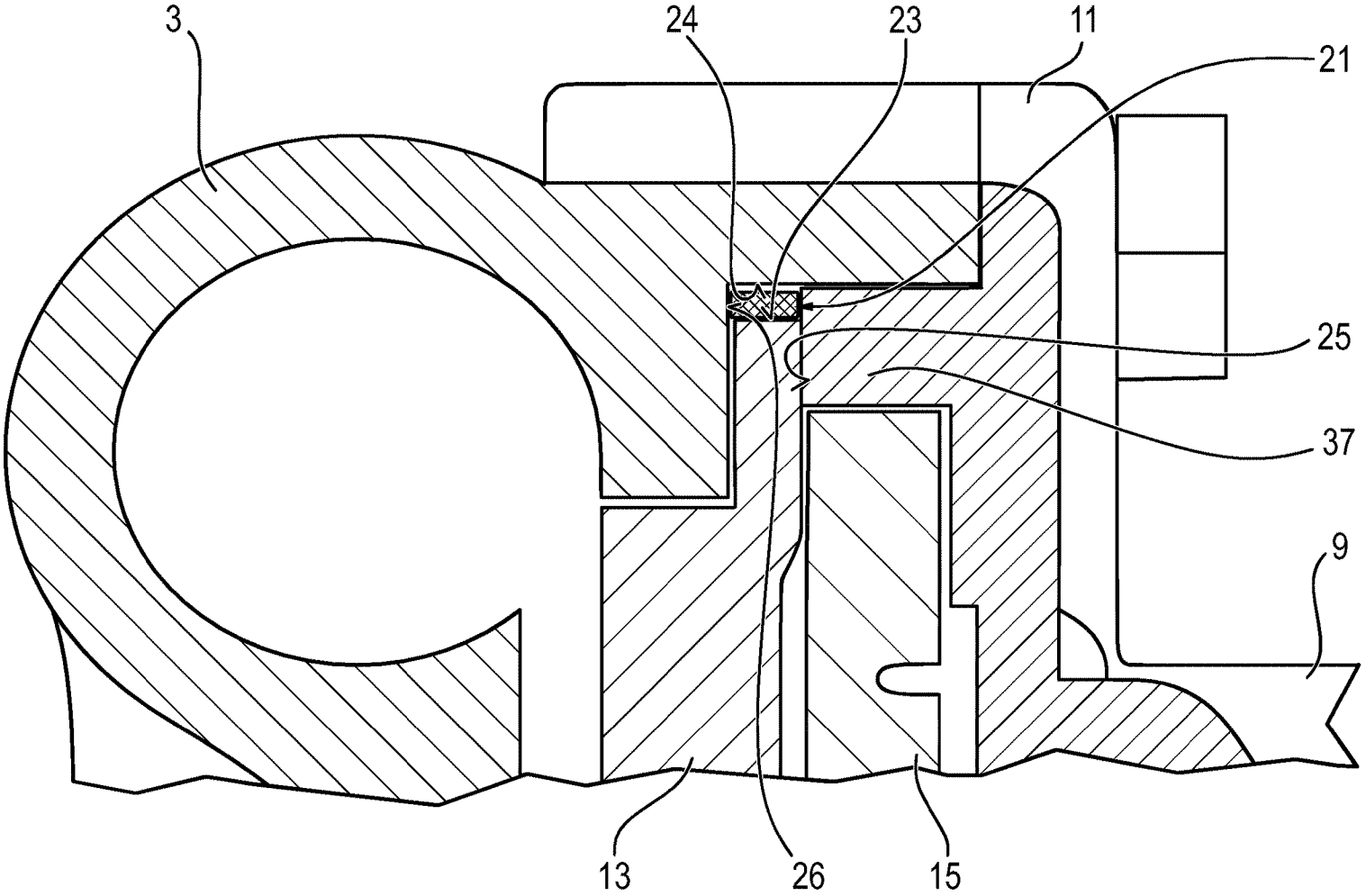
FIG. 2 shows a detail view relating to the first seal of the supercharging device according to the invention as per the exemplary embodiment.

At least one first seal 21 and one second seal 22 are provided for the hermetic sealing of the receiving space 14. Said seals 21, 22 will be discussed on the basis of the detail illustrations in FIGS. 2 and 3. FIG. 2 shows the first seal 21 in detail. The compressor housing 3 has a first inner circumferential surface 24. The wall 11 has a first radial surface 25. A first outer circumferential surface 23 is defined on the rear wall 13. The first seal 21 is arranged between the first radial surface 25 of the wall 11 and a second radial surface 26 of the compressor housing 3. Thus, the first seal 21 is subjected to load only in the axial direction 18. The compressor housing 3 has a second radial surface 26. The first seal 21 is arranged around the full circumference between the first outer circumferential surface 23, the first inner circumferential surface 24, the first radial surface 25 and the second radial surface 26, and is braced between the first radial surface 25 and the second radial surface 26 in the axial direction 18, whereby the sealing action is generated. The sealing between the first radial surface 25 and the first seal 21 is not as intense as that between the second radial surface 26 and the first seal 21, in order for the rear wall 13 to be positioned on the motor housing 9 during the compression.

FIG. 3 shows recesses in the rear wall 13 and in the wall 11, which recesses serve for the leadthrough of the shaft 8 from the motor space 10 into the compressor space. Furthermore, FIG. 3 shows the arrangement of the second seal 22 in detail. The second seal 22 is arranged around the full circumference on a second outer circumferential surface 28 of the wall 11. Furthermore, said second seal 22 bears against a second inner circumferential surface 27 of the rear wall 13.

FIG. 1 shows an electrical conductor 29 in the form of a pin. The electrical conductor 29 produces electrically conductive contact between the power electronics circuit 15 and the coils of the stator 7. For this purpose, the electrical conductor 29 projects through the wall 11. At this location, a third seal 30 is provided in the region of the wall 11. The third seal 30 is a seal mounted in the manner of a hose on the electrical conductor 29. To prevent any short-circuits in the region of the electrical conductors, it may be provided that the third seal extends over at least half of the length of the stator, preferably over at least two thirds of the length of the stator, in the axial direction. The third seal preferably has encircling elevations, in particular in the region of the passage hole through the wall 11, in order to locally generate a relatively high contact pressure with respect to the passage hole in the wall 11. Thus, the third seal 30 serves not only for sealing off the passage hole in the wall 11 but also for electrically insulating the electrical conductor 29 with respect to the stator 7.

In particular, three such electrical conductors 29 are used, which are distributed over the circumference. The electrical conductors 29 extend over the entire axial length of the stator 7, such that the electrical conductors 29 can be placed in contact with the stator 7 in the region of the cover 12. That is to say, the electrical conductors 29 advantageously extend in the axial direction 18 over the entire length of the stator. The contacting between the stator 7 and electrical conductor 29 can thus, for assembly reasons, be realized on that side of the stator 7 which faces away from the compressor 2. In particular, the electrical conductors 29 and the stator 7 may be electrically connected to one another for example by way of a crimped connection. Owing to the length of the electrical line 29 and the crimping on the side facing away from the power electronics circuit 15, assembly damage to the power electronics circuit 15 as a result of the crimping process can be prevented. On that side of the stator 7 which faces away from the compressor 2, the motor housing has a cover 12. Before the mounting of said cover 12, it is possible, at said side, for the electrical conductors 29 to be connected in electrically conductive fashion to the windings on the stator 7, for example by crimping as described. Only then is the cover 12 correspondingly mounted. This arrangement permits simple assembly of the supercharging device 1, which is of very compact construction. Altogether, the configuration and arrangement of the electrical conductors 29 thus has the advantages of fast and simple assembly with a low risk of assembly-induced damage, without the need to accept large power losses in the electrical connection.

Figure 6:
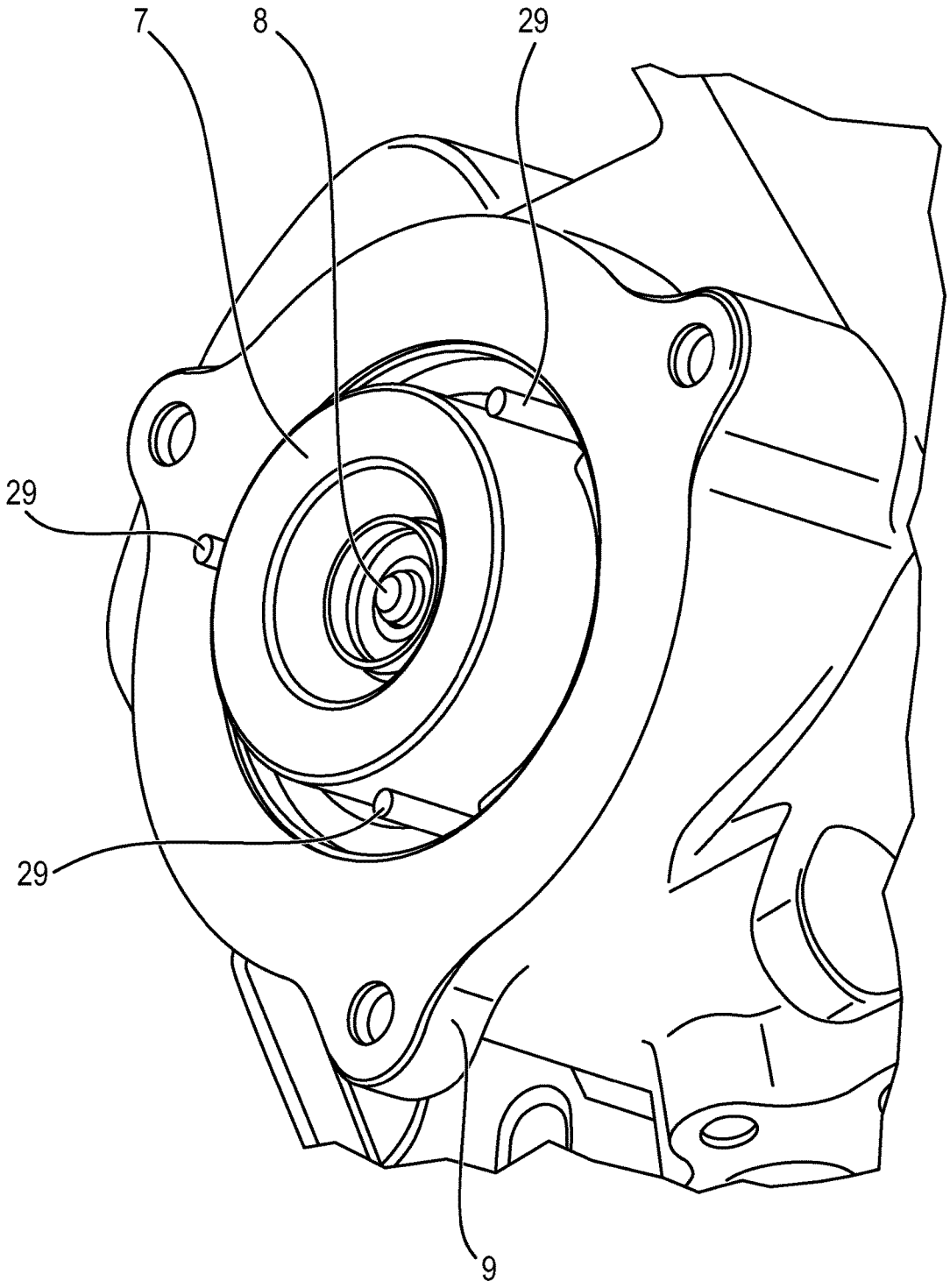
FIG. 6 shows a detail of the supercharging device according to the invention as per the exemplary embodiment, with the cover dismounted.

FIG. 6 shows a side of the motor housing 9 facing away from the compressor 2, with the cover 12 dismounted. From this illustration, it can be clearly seen that, when the cover 12 is dismounted, the ends of the electrical conductors 29 and the stator 7 are accessible. Before the mounting of the cover 12, it is thus possible for the ends of the electrical conductors 29 to be connected in an electrically conductive fashion to the stator 7, as described above.

As shown in detail in FIGS. 1 and 3, a contactless fourth sealing point 31 is provided between the wall 11 and the shaft 8. Said fourth sealing point 31 is situated in particular radially within the second seal 22.

Figure 4:
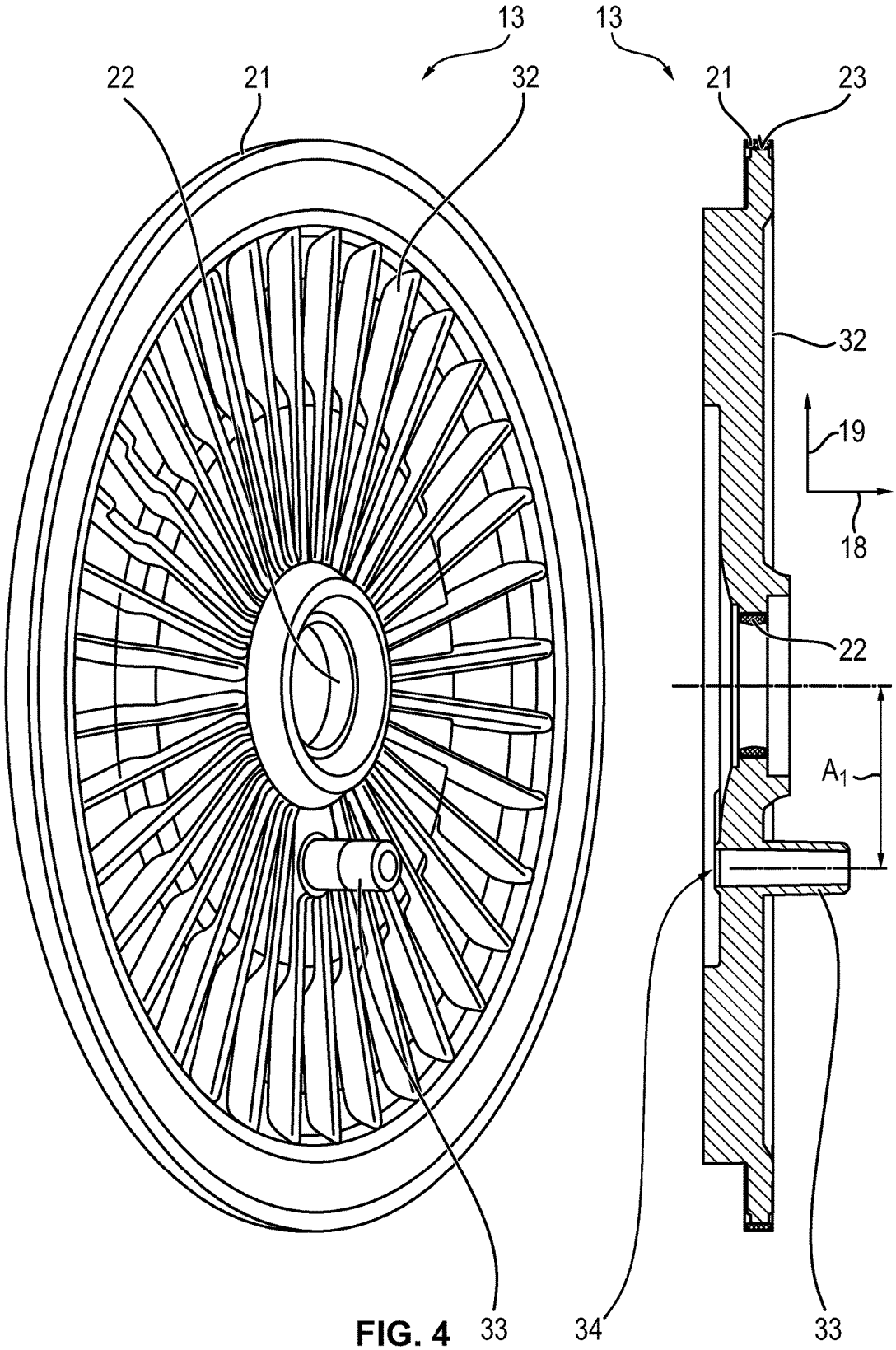
FIG. 4 shows two views of a rear wall of the supercharging device according to the invention as per the exemplary embodiment.

FIG. 4 shows, in an isometric, sectional view, the precise design of the rear wall 13. The rear wall 13 is a component which is manufactured in one piece.

In particular, FIG. 4 shows the precise arrangement of the first and second seals 21, 22 on the rear wall 13. In particular, the two seals 21, 22 are seals which are adhesively bonded on or vulcanized on and which are arranged over the full circumference. Alternatively or in addition, the first seal 21 and/or the second seal 22 may be arranged in a groove in the rear wall 13, or a corresponding projection may be formed on the rear wall 13, which projection projects into a corresponding groove in the first seal 21 and/or second seal 22.

Furthermore, the illustrations in FIG. 4 show multiple reinforcement ribs 32, which are integral constituent parts of the rear wall 13. The reinforcement ribs 32 are arranged in stellate form in the radial direction 19 and are situated on the side facing toward the receiving space 14.

A further constituent part of the rear wall 13 is a pipe stub 33 which serves as a fluid-conducting connection between the compressor space and the motor space 10. Said pipe stub is situated at a geodetically low-lying position, that is to say below the shaft 8. As shown in particular in FIG. 1, the fluid-conducting connection or the pipe stub 33 forms a fluid-conducting connection between the compressor space and the motor space 10. By means of a fifth seal 35, the pipe stub 33 is sealed off with respect to the wall 11. The pipe stub 33 permits pressure equalization between the compressor space and the motor space 10. Here, the pipe stub 33 is formed such that only a fluid-conducting connection between compressor space and motor space 10, and not a fluid-conducting connection into the receiving space 14, is realized. It may be provided that the pipe stub 33 is an integral constituent part of the rear wall 13, which is manufactured in one piece. The pipe stub 33 is situated eccentrically with respect to the shaft 8 of the supercharging device 1. The direct fluid-conducting connection from the compressor space into the motor space has the advantage that large pressure differences between the motor space and the compressor space can be avoided. In this way, the forces on the seals and the bearings that arise for example owing to high pressures without pressure equalization can be eliminated or reduced. This reduces the risk of lubricant or the like being forced out of the bearings and/or seals into the compressor space and/or the motor space and causing damage there.

The fluid-conducting connection between the compressor space and the motor space 10 for permitting the pressure equalization may have further components. For example, a diaphragm may be provided, in particular a semipermeable diaphragm, for the targeted passage of gases and retention of solid or liquid particles. A diaphragm of said type may, in the embodiment shown in the Figures, be mounted in the pipe stub 33, on the rear wall 13 at the inlet opening 34 and/or at an outlet of the pipe stub 33 in the region of the motor space 10. In addition or alternatively, a device may also be provided which regulates or controls the fluid-conducting connection or the throughflow through the fluid-conducting connection between the spaces. Such a device may be integrated in the form of a valve and/or a nozzle, for example a Venturi nozzle. This has the advantage that, by means of the fluid-conducting connection between the compressor space and the motor space, not only is a pressure equalization made possible, but at the same time the pressure equalization can be controlled and/or regulated, and/or contamination by liquids or particles can be prevented.

Figure 5:
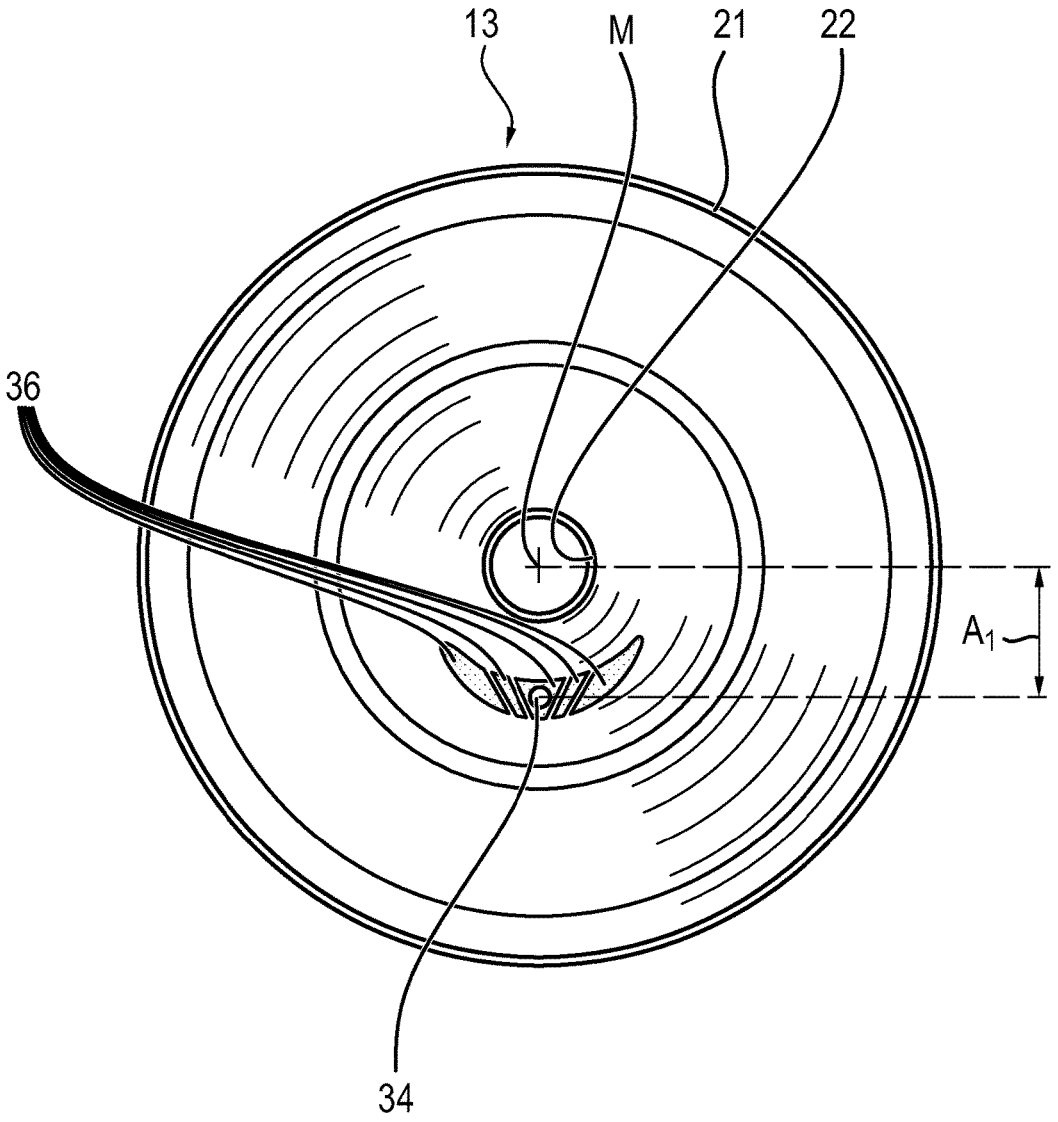
FIG. 5 shows a further view of the rear wall of the supercharging device according to the invention as per the exemplary embodiment.

FIG. 5 shows a plan view of that side of the rear wall 13 which faces toward the compressor 2. It can be clearly seen that multiple elevations 36 are arranged around the inlet opening 34 of the pipe stub 33. Said elevations 36 extend in sickle-shaped form in the circumferential direction 20 around the inlet opening 34. Said elevations 36 serve to channel particles away such that, with high probability, said particles do not pass into the inlet opening 34 and thus into the pipe stub 33. Particles should to the greatest possible extent be prevented from passing via the inlet opening 34 of the pipe stub 33 into the motor space 10. Such particles may in particular be burned oil droplets or soot particles. An embodiment of the elevations 36 will be described in more detail below on the basis of FIGS. 1, 4, 5, 7 and 8.

The compressor wheel has a certain diameter D1 (see FIG. 1). The center of an inlet opening 34 of the pipe stub 33 in the rear wall 13 is spaced apart from a central point M of the rear wall by a distance A1. The distance A1 lies preferably in a range of 0.2*(D1/2) and 0.9*(D1/2), in particular between 0.4*(D1/2) and 0.8*(D1/2).

Figure 7:
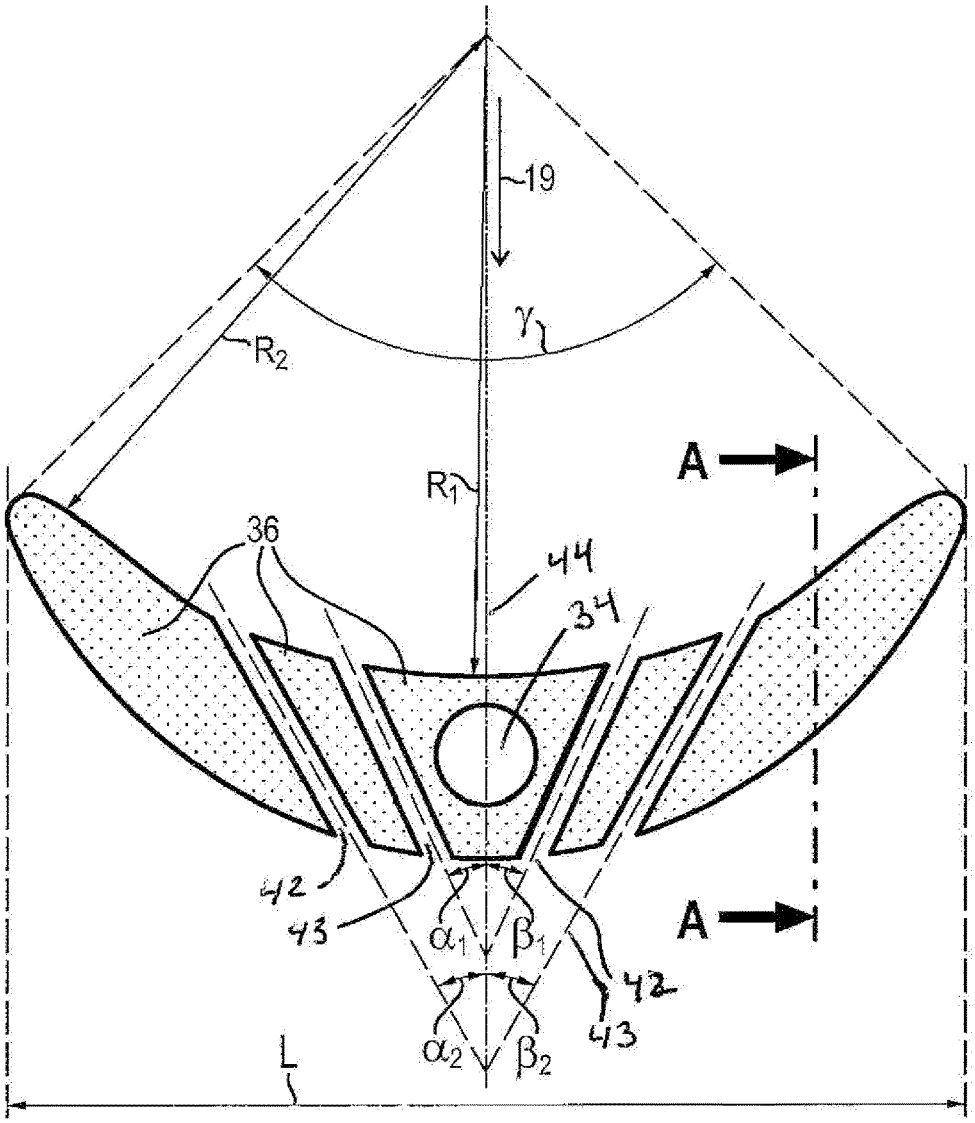
FIG. 7 shows details of the configuration of the elevations on the rear wall as per an advantageous embodiment of the supercharging device.

As can be seen in FIG. 5, a multiplicity of elevations 36 extend on the rear wall 13 in the circumferential direction. Here, one elevation 36 surrounds the inlet opening 34 of the pipe stub 33 around the full circumference. FIGS. 5 and 7 show a sickle-shaped arrangement of the elevations 36 in the circumferential direction around the inlet opening 34. During the operation of the supercharging device, the elevation or elevations 36 have the effect that particles, owing to their inertia, are at least with high probability centrifuged past the inlet opening 34 and are not discharged with the condensate but are supplied with the compressed air to the combustion process in the internal combustion engine.

As shown in FIG. 7, the elevations 36 are separated from one another by a depression. Furthermore, FIG. 7 shows an imaginary line 44 connecting the center of the inlet opening and the central point M which runs through the center of the inlet opening 34 and through the central point M of the rear wall 13. The depressions extend along imaginary auxiliary axes, which are likewise illustrated in FIG. 7. The auxiliary axes of the depressions intersect the line 44 connecting the center of the inlet opening and the central point M radially outside the inlet opening 34.

As can be seen in FIG. 7, in each case one first depression and a corresponding multiplicity of elevations 36 are provided in front of and behind the inlet opening 34 as viewed in the circumferential direction. The auxiliary axes of the first depressions then enclose a first angle ($\alpha_1$, $\beta_1$) respectively with the line 44 connecting the center of the inlet opening and the central point M. Furthermore, second depressions and correspondingly further elevations 36 are provided in front of and behind the first depressions as viewed in the circumferential direction. The auxiliary lines of the second depressions enclose a second angle ($\alpha_2$, $\beta_2$) respectively with the line 44 connecting the center of the inlet opening and the central point M. The first and second angles ($\alpha_1$, $\beta_1$, $\alpha_2$, $\beta_2$) each lie between 70° and 20°, in particular between 60° and 25°. The first angles ($\alpha_1$, $\beta_1$) are preferably smaller than the second angles ($\alpha_2$, $\beta_2$). In particular, the first angles ($\alpha_1$, $\beta_1$) amount to at most 95% of the second angles ($\alpha_2$, $\beta_2$).

As described above, and as can be seen in FIG. 1, the compressor wheel 4 has the diameter D1 (largest diameter of the compressor wheel 4). The totality of the elevations 36 may extend over a length L (see FIG. 7). The length L is measured perpendicular to the line 44 connecting the center of the inlet opening and the central point M and parallel to a plane spanned by the rear wall 13. The length L thus lies perpendicular to the axis of the shaft 8. The length L preferably amounts to between 0.7*D1 and 0.2*D1, in particular between 0.6*D1 and 0.3*D1.

FIG. 7 shows that the totality of the elevations 36 extends over a segment angle which is measured with respect to the central point M of the rear wall 13 and in the plane of the rear wall 13. The segment angle $\gamma$ lies between 120° and 45°, in particular between 100° and 60°.

As shown in FIG. 7, the radially inner edge of the elevations 36 follows an arc. The arc has a continuously varying radius with respect to the central point M. At the line 44 connecting the center of the inlet opening and the central point M, the arc has a first radius R1. The radius increases up to a second radius R2 toward the outer ends of the elevations 36. In this case, the second radius R2 amounts to at least 110% of the first radius R1.

Figure 8:
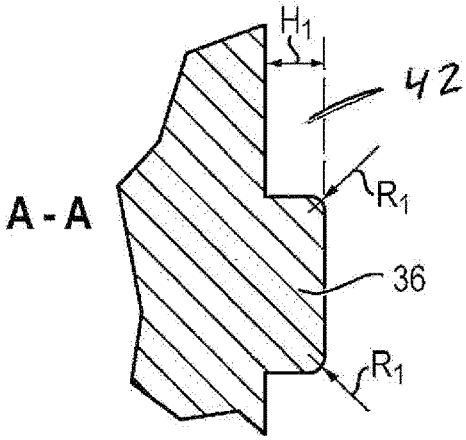
FIG. 8 shows details of the configuration of the elevations on the rear wall as per an advantageous embodiment of the supercharging device, in section.

FIG. 8 shows a sectional view (along the section line A-A in FIG. 7) through one of the elevations 36. A height H1 of the elevation 36 measured in an axial direction amounts to between 0.1 mm and 5 mm, in particular between 0.1 mm and 1 mm.

The edges of the elevation 36 can likewise be seen in FIG. 8. The edges of the elevation 36 are rounded with a defined radius R3. The radius preferably lies between 0.05 mm and 0.1 mm.

As can be seen in FIG. 7, the arrangement of the elevations 36 and of the corresponding depressions is symmetrical with respect to the line 44 connecting the center of the inlet opening and the central point M which runs through the center of the inlet opening 34 and through the center M of the rear wall 13.

The various features, described in detail, relating to the configuration and positioning of the inlet opening 34 and of the elevations 36 have been determined on the basis of calculations, simulations and tests, and may be used individually or in synergistically interactive combination to prevent particles from passing into the motor space 10 via the inlet opening 34 and the fluid-conducting connection. By contrast to the conventional and logical solution, specifically that of sealing off the motor space 10, it has been identified that the provision of a fluid-conducting connection for pressure equalization, for example in the form of a pipe stub 33, and the elevations 36 in the region of the inlet opening 34 is significantly easier and cheaper than completely sealing off the motor space, with the correspondingly required pressure equalization.

Figure 9:
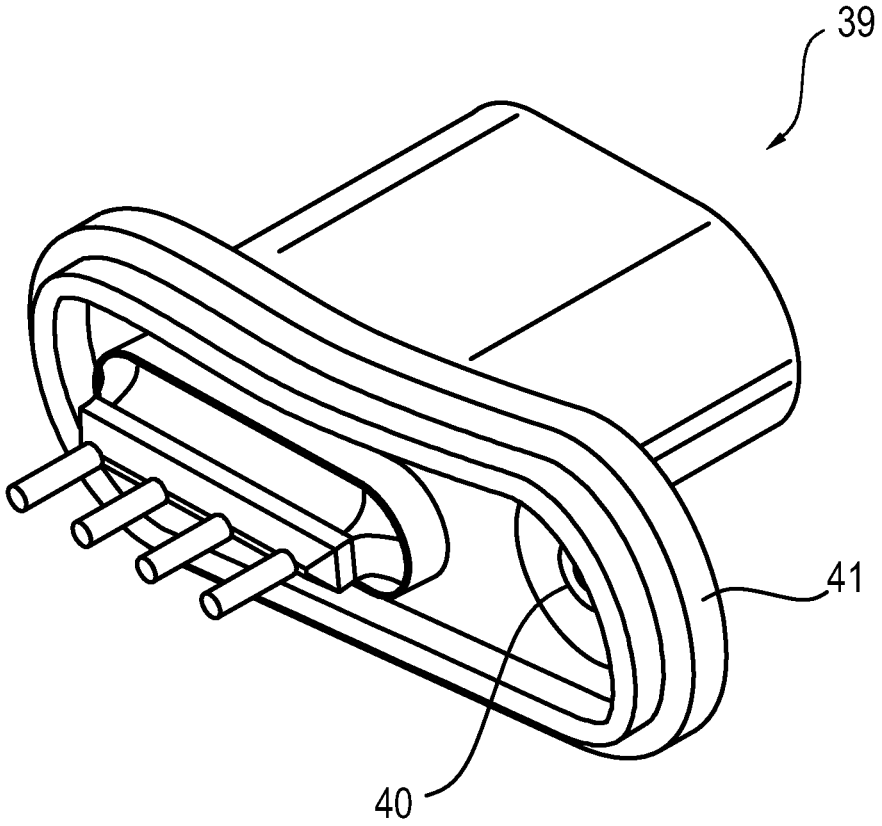
FIG. 9 shows a view of a plug connector with integrated means for pressure equalization between the receiving space and the surroundings.

FIG. 9 shows an optional design for a means 40 for permitting pressure equalization between the receiving space 14 and the surroundings. In general, the means 40 for pressure equalization may be any type of fluid-conducting connection, for example one or more holes or bores, which permit pressure equalization between the receiving space 14 and the surroundings. The means 40 for pressure equalization may have a diaphragm, in particular a semipermeable diaphragm. Said diaphragm may thus be impermeable to liquids and permeable to gases, such that pressure equalization between the receiving space 14 and the surroundings is possible. The diaphragm may for example be mounted in the region of the fluid-conducting connection in the form of one or more holes or bores, above/below or in the latter. For the electrical contacting of the power electronics circuit 15 in the receiving space 14, a fluid-conducting connection of the receiving space 14 to the surroundings may be provided, for example by way of a plug connector 39. In particular, the means 40 for pressure equalization may be integrated into a plug connector 39 of said type, as shown in FIG. 9. The plug connector 39 may be suitable for the control of the power electronics circuit 15 and/or for the supply of power to the electric motor 5. For example, the means 40 for pressure equalization may be integrated in a collar 41 of the plug connector 39. This has the advantage that a single component can be used both for the electrical contacting of the power electronics circuit 15 and for permitting a pressure equalization. In addition, the means 40 for pressure equalization may also comprise a valve and/or a nozzle, for example in the form of a Venturi nozzle. Controlled and regulated pressure equalization is thus made possible.

In addition to the above written disclosure of the invention, reference is hereby explicitly made, for supplementation of said disclosure, to the illustrative representation of the invention in FIGS. 1 to 9.

LIST OF REFERENCE SIGNS

1 Supercharging device
2 Compressor
3 Compressor housing
4 Compressor wheel
5 Electric motor
6 Rotor
7 Stator
8 Shaft
9 Motor housing
10 Motor space
11 Wall
12 Cover
13 Rear wall
14 Receiving space
15 Power electronics circuit
16 First bearing
17 Second bearing
18 Axial direction
19 Radial direction
20 Circumferential direction
21 First seal
22 Second seal
23 First outer circumferential surface (of the rear wall)
24 First inner circumferential surface (of the compressor housing)
25 First radial surface (of the wall)
26 Second radial surface (of the compressor housing)
27 Second inner circumferential surface (of the rear wall)
28 Second outer circumferential surface (of the wall)
29 Electrical conductor
30 Third seal
31 Fourth sealing point
32 Reinforcement ribs
33 Fluid-conducting connection/pipe stub
34 Inlet opening
35 Fifth seal
36 Elevations
37 Axially extending section
38 O-rings
39 Plug connector
40 Means for pressure equalization between the receiving space and surroundings
41 Collar of the plug connector

The invention claimed is:

1. A supercharging device (1) for an internal combustion engine, wherein the supercharging device has:

a compressor (2) having a compressor housing (3) and having a compressor space in which a compressor wheel (4) is arranged, an electric motor (5) having a motor housing (9) which defines a motor space (10) in which a rotor (6) and a stator (7) are arranged, and a fluid-conducting connection comprising an inlet opening (34) from the compressor space into the motor space (10) in order to permit pressure equalization between the compressor space and the motor space (10), wherein the inlet opening (34) is formed in a first elevation (36) that channels away particles from the inlet opening (34) of the fluid-conducting connection (33), wherein the first elevation (36) is located on the side of the rear wall (13) which faces toward the compressor (2).

2. The supercharging device according to claim 1, wherein the compressor housing (3) is closed on the side facing toward the motor housing (9) by a rear wall (13), wherein the rear wall (13) is situated opposite a front wall (11) of the motor housing (9), and wherein a the receiving space (14) for receiving a power electronics circuit for controlling the electric motor is arranged between the front wall (11) and the rear wall (13).

3. The supercharging device according to claim 1, wherein the center of the inlet opening (34) of the connection in the rear wall (13) is spaced apart from a central point M of the rear wall by a distance $A_1$.

4. The supercharging device according to claim 3, wherein the compressor wheel has a diameter $D_1$, wherein the distance $A_1$ is between $0.4*(D_1/2)$ and $0.8*(D_1/2)$.

5. The supercharging device according to claim 1, wherein the first elevation (36) extends in a circumferential direction.

6. The supercharging device according to claim 5, wherein the first elevation (36) is arranged over the full circumference around the inlet opening (34).

7. The supercharging device according to claim 1, wherein a second elevation is provided, wherein the first and second elevations are separated from one another by a depression (42).

8. The supercharging device according to claim 7, wherein a line (44) connects the center of the inlet opening and the central point M of the rear wall, and wherein the depression (42) extends along an auxiliary axis, and wherein the line (44) connecting the center of the inlet opening and the central point M intersects the auxiliary axis radially outside the inlet opening (34).

9. The supercharging device according to claim 8, wherein each elevation (36) is provided in front of and behind the inlet opening (34) as viewed in the circumferential direction, and wherein corresponding auxiliary axes along which the first depressions (42) extend enclose a first angle ($\alpha_1$, $\beta_1$) respectively with the line (44) connecting the center of the inlet opening and the central point M, and the auxiliary axes intersect the line of centers radially outside the inlet opening.

10. The supercharging device according to claim 9, wherein at least one second depression (42) and corresponding further elevations (36) are provided in front of and behind the first depressions (42) as viewed in the circumferential direction, and wherein corresponding auxiliary axes (43) of the second depressions (42) enclose a second angle ($\alpha_2$, $\beta_2$) respectively with the line (44) connecting the center of the inlet opening and the central point M.

11. The supercharging device according to claim 10, wherein the first and second angles ($\alpha_1$ plus $\beta_1$, $\alpha_2$ plus $\beta_2$) each lie between 70° and 20°.

12. The supercharging device according to claim 10, wherein the first and second angles ($\alpha_1$ plus $\beta_1$, $\alpha_2$ plus $\beta_2$) each lie between 60° and 25°.

13. The supercharging device according to claim 10, wherein the first angles ($\alpha_1$, $\beta_1$) are smaller than the second angles ($\alpha_2$, $\beta_2$).

14. The supercharging device according to claim 10, wherein the first angles ($\alpha_1$, $\beta_1$) amount to at most 95% of the second angles ($\alpha_2$, $\beta_2$).

15. The supercharging device according to claim 1, wherein the elevations (36) collectively extend over a length L measured perpendicular to the line (44) connecting the center of the inlet opening and the central point M and parallel to a plane spanned by the rear wall (13), wherein, the compressor wheel has a diameter $D_1$, and wherein the length L amounts to between $0.7*D_1$ and $0.2*D_1$.

16. The supercharging device according to claim 15, wherein the length L amounts to between $0.6*D_1$ and $0.3*D_1$.

17. The supercharging device according to claim 1, wherein the the elevations (36) collectively extend over a segment angle γ measured with respect to the central point M, wherein the segment angle lies between 120° and 45°.

18. The supercharging device according to claim 1, wherein the the elevations (36) collectively extend over a segment angle γ measured with respect to the central point M, wherein the segment angle lies between 100° and 60°.

19. The supercharging device according to claim 1, wherein radially inner edges of the elevations extend along an arc, wherein the arc has a continuously varying radius with respect to the central point M of the rear wall (13), wherein the arc defines a first radius $R_1$ on the line of centers, wherein the radius increases along the arc up to a second radius $R_2$ at the outer ends of the elevations, and wherein the second radius $R_2$ amounts to at least 110% of the first radius $R_1$.

* * * * *